US005199706A

United States Patent [19]

Chen

[11] Patent Number: 5,199,706

[45] Date of Patent: Apr. 6, 1993

[54] GRIP ASSEMBLY FOR A RACKET

[76] Inventor: Dennis Chen, Suite 1, 11F, 95-8 Chang Ping Road, Sec. 1, Taichung, Taiwan

[21] Appl. No.: 884,417

[22] Filed: May 18, 1992

[51] Int. Cl.[5] ..... A63B 49/08

[52] U.S. Cl. ..... 273/75; 273/81 R; 273/73 J

[58] Field of Search ..... 273/73 R, 2, 75, 81 R, 273/81 D, 81.4, 165

[56] References Cited

U.S. PATENT DOCUMENTS 4,098,506 7/1978 Gaiser ..... 273/75

FOREIGN PATENT DOCUMENTS 3831586 3/1980 Fed. Rep. of Germany ..... 273/73 J 3211428 10/1983 Fed. Rep. of Germany ..... 273/73 J

*Primary Examiner*—V. Millin

*Assistant Examiner*—Raleigh W. Chiu

[57] ABSTRACT

A grip assembly for a games racket comprises a plurality of interchangeable, generally annular elastic bands which are tautly positionable around the grip or handle thereof. The elastic bands are imbricated on the grip to form a plurality of circumferential air cavities which absorb concomitant shock and vibration caused by the impact of a ball, and a plurality of circumferential grooves which provides a superior grip to a user's hands.

9 Claims, 5 Drawing Sheets

GRIP ASSEMBLY FOR A RACKET

BACKGROUND OF THE PRESENT INVENTION

The present invention relates to a grip assembly for a games racket, and more particularly to a removable and interchangeable grip assembly comprising a plurality of elastic bands for mounting on the handle portion of a games racket.

In conventional forms of games rackets, and particularly in tennis rackets, a grip is formed around a handle portion of the racket shaft by wrapping an adhesively backed tape thereon in a helical fashion. Though having long been in use, this conventional form of racket grip does suffer from a number of deficiencies. Most significantly, the tape tends to slide or peel after exposure to the strains and sweat induced moisture of a prolonged usage. As repair of the grip usually requires the complete stripping of the tape and subsequent reapplication, considerable time and expense is involved in its upkeep. Furthermore, the conventional taped grip provides no simple means of adjusting the grip's form or feel so as to suit a particular user's hands or playing style.

The grip assembly of the present invention was accomplished in light of these shortcomings of the conventional tape grip so as to provide a versatile grip for a games racket comprising a plurality of elastic bands that can be quickly removed and interchanged if worn or damaged, or when a grip of different form or feel using an alternate set of bands is desired.

SUMMARY OF THE PRESENT INVENTION

The present invention has as a main object to provide a removable and interchangeable grip assembly for a games racket comprising in accordance therewith a plurality of generally annular, elastic bands which are tautly positionable on corresponding sections of a handle portion or preformed grip of the racket.

A further object of the present invention is to provide a removable and interchangeable grip assembly as characterized wherein the elastic bands are wrapped around corresponding sections of the handle portion in an imbricated fashion with each elastic band overlapping an end portion of a preceding band.

Another object of the present invention is to provide a removable and interchangeable grip assembly further characterized in having a plurality of circumferential air filled cavities defined between adjacent elastic bands on the handle portion of the racket for absorbing concomitant shock created therein by the impact of a ball.

Still another object of the present invention is to provide a removable and interchangeable grip assembly further characterized in having a plurality of circumferential grooves defined by the recessed outer peripheries of adjacent elastic bands on the handle portion of the racket for facilitating a user's grip thereon.

Other objects and advantages of the grip assembly of the present invention will become apparent with reference to the detailed description of the preferred embodiments thereof provided below along with accompanying drawings.

DETAILED DESCRIPTION OF THE PREFERRED EMBODIMENTS

Figure 1:
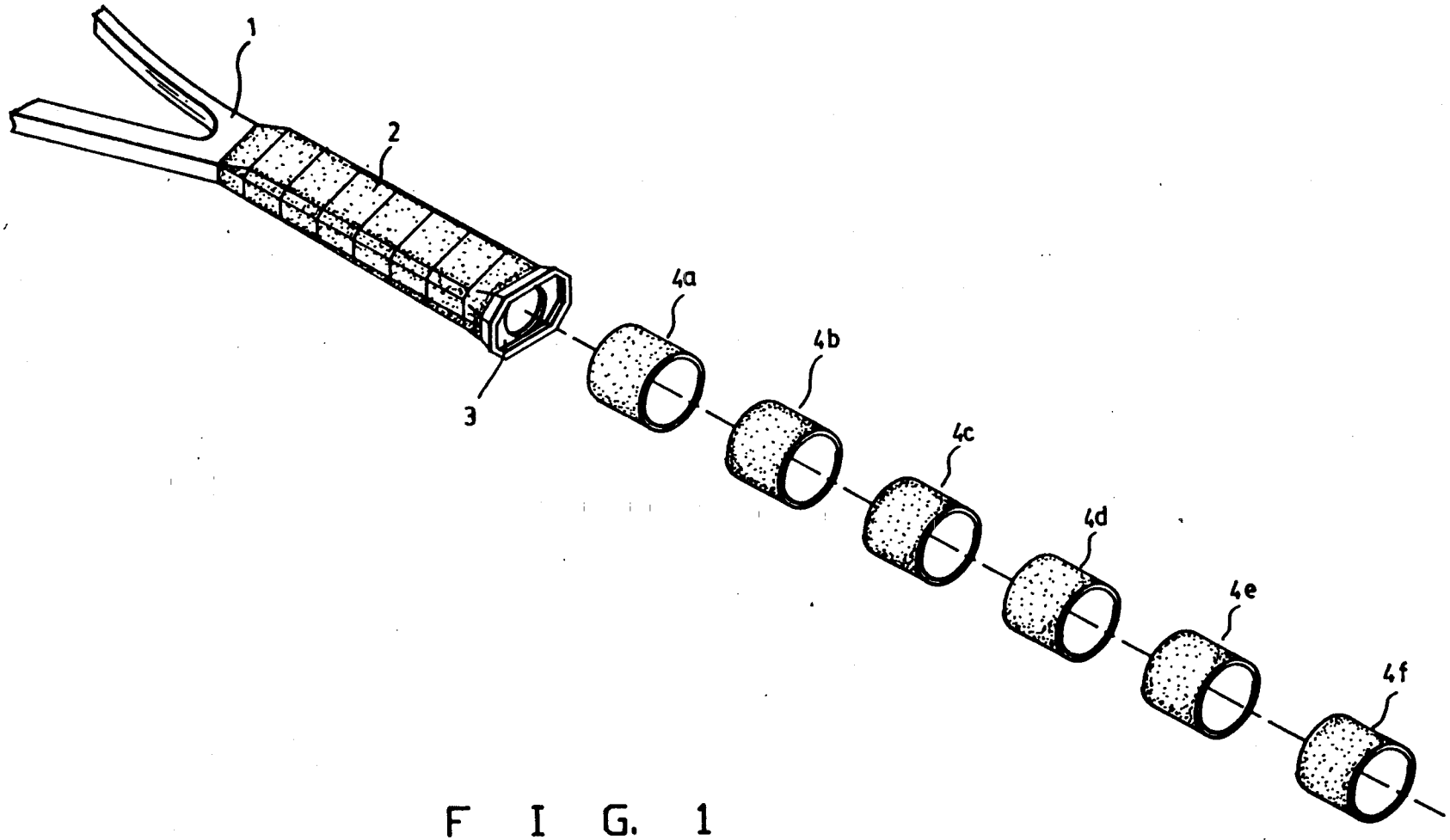
FIG. 1 is a perspective view of the grip assembly of the present invention prior to mounting on the shaft and grip of a tennis racket.

Referring to the drawings, the grip assembly of the present invention comprises a plurality of annular, elastic bands 4a to 4f which are positionable around a grip 2 of a tennis racquet comprising a frame (not shown), a shaft 1 adjoining therewith, and the grip 2 provided around the handle portion of the shaft near the free end thereof. The grip is formed in the conventional manner by wrapping an adhesive backed tape around the handle portion of the shaft and covers a butt plate 3 fixed in the open end thereof.

Figure 2:
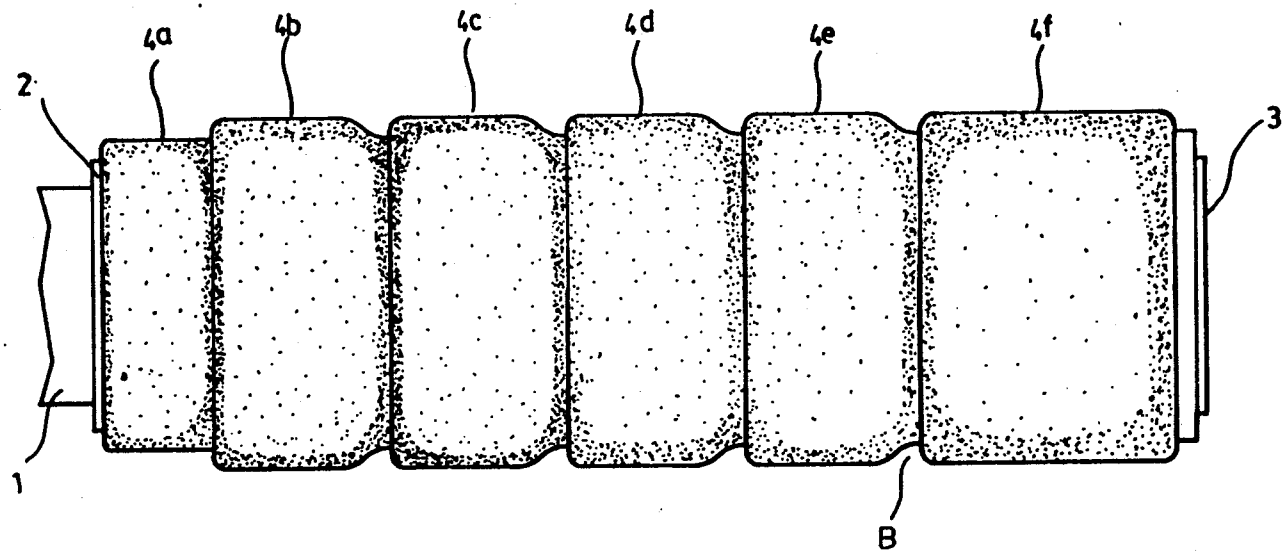
FIG. 2 is a side view of the grip assembly mounted on the shaft of a racket.
Figure 3:
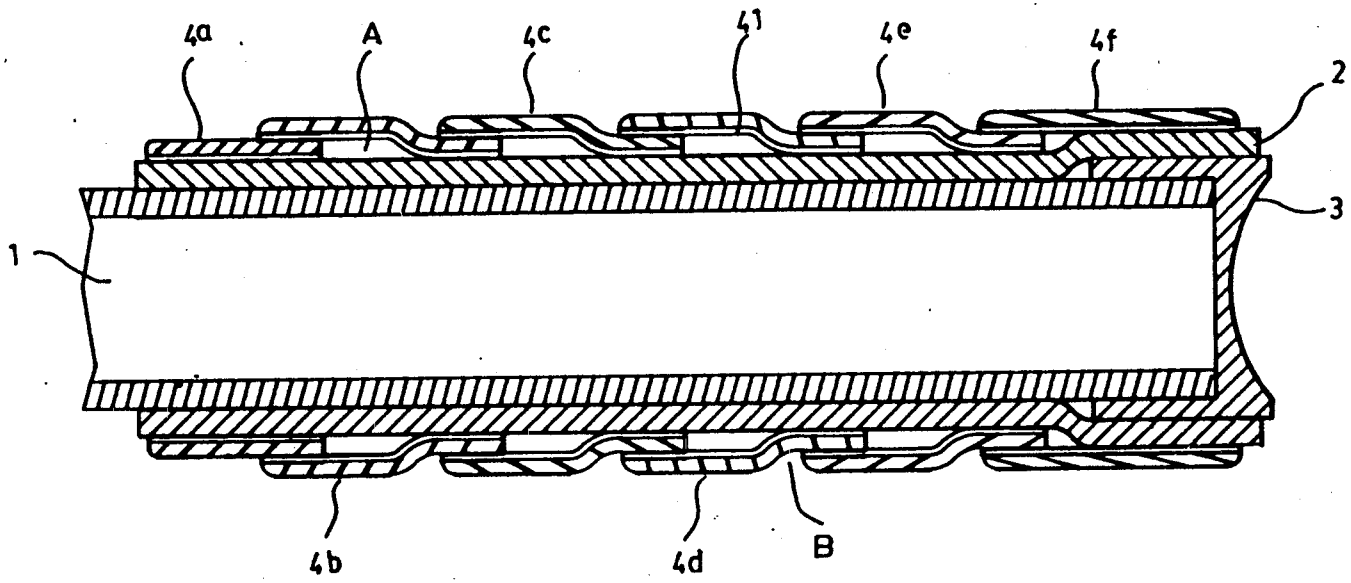
FIG. 3 is a longitudinal sectional view of the mounted grip assembly of FIG. 2.

Each elastic band 4a to 4f is generally cylindrical in form and has circular ends with the inner diameter thereof being less than the cross section of a corresponding section of the handle portion on which it is to be positioned. The elastic bands 4a to 4f are mounted in sequence along grip 2 by radially stretching each band and positioning it over the corresponding section thereon. As shown in FIGS. 2 and 3, band 4a is positioned near a distal edge of grip 2 which is farthest from butt plate 3 while band 4b is adjacent with band 4a and overlaps a proximal end portion thereof. Similarly, bands 4c to 4f are positioned on corresponding sections of the grip extending to butt plate 3 with each band overlapping a proximal end portion of a preceding band. The tension in each elastic band exerts a sufficiently large compression force on the underlying grip surface and covered outer periphery of an adjacent band to firmly position the band on the racket. To further the grip of the bands thereon, an inner traction layer 41 having a coarse inner surface is provided around the inner periphery of each elastic band.

A circumferential air filled cavity A defined between each adjacent pair of elastic bands and the underlying grip 2 acts to absorb concomitant shock and vibration generated in the racket by the impact of a ball so as to protect a user from injury and fatigue. In addition, the recessed taper portions of the medial bands 4b to 4c and the rounded ends of bands in abutment therewith define circumferential grooves B which serve to provide a more conforming grip to a user's hands to further increase the playing effectiveness and comfort of the user.

Removal of the elastic bands is just as readily accomplished by stretching and sliding the bands off the butt plate starting with band 4f nearest thereto and so on with the preceding bands. Afterwhich, a replacement set of perhaps different characteristic could be mounted onto the racket.

Figure 4:
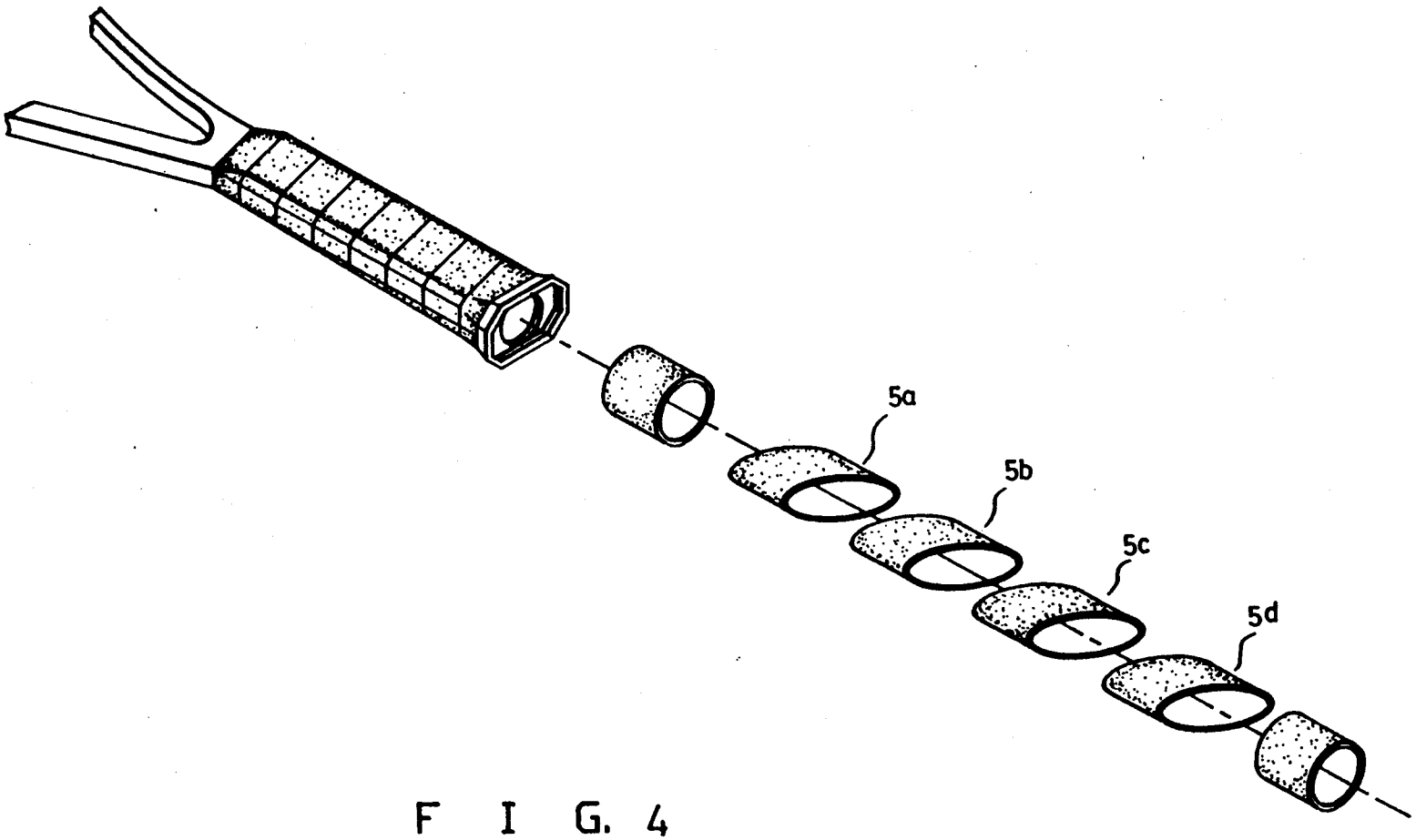
FIG. 4 is a perspective view of an alternate grip assembly prior to mounting on the shaft and grip of a tennis racket.
Figure 5:
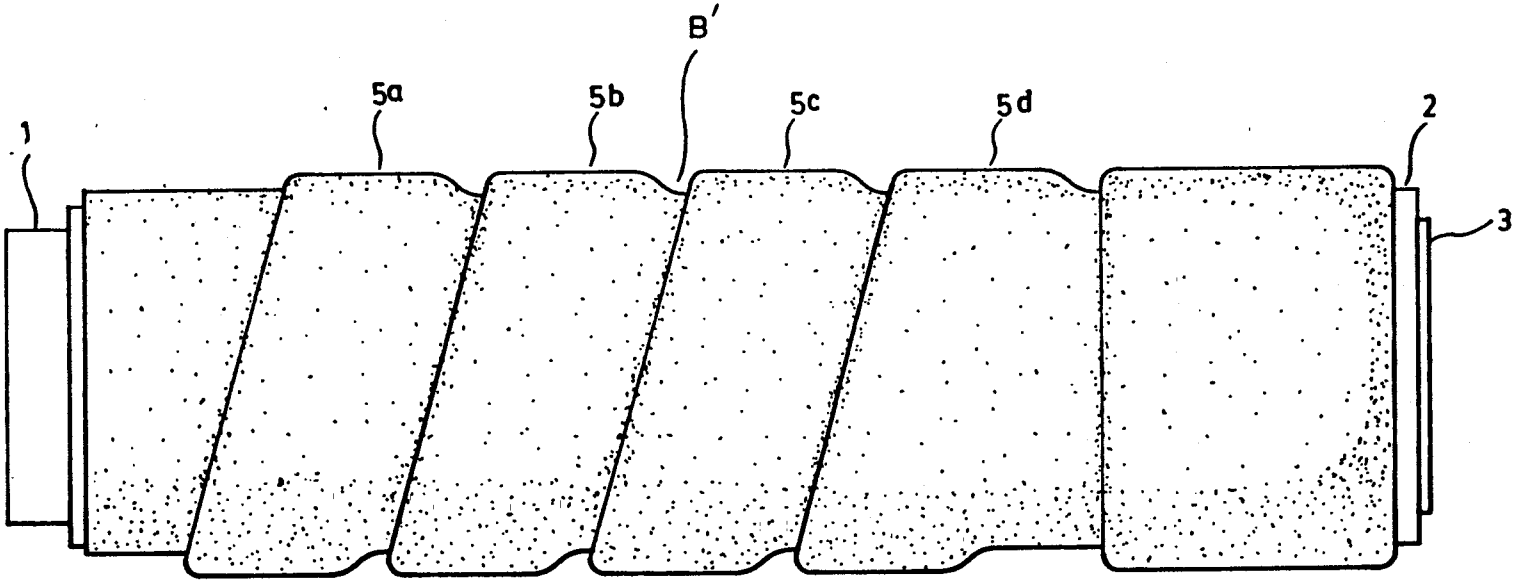
FIG. 5 is a side view of the grip assembly of FIG. 4 mounted on the shaft of a racket.

Elastic bands 5a to 5b of an alternate embodiment, as shown in FIGS. 4 and 5, have parallel elliptical ends so as to provide an angled set of grasping grooves B' which may be more accomodating to particular user's. As with the previous embodiment, the set of bands are positioned around corresponding sections of the grip 2 in an imbricated fashion and form air cavities A therebetween.

Note that though the described implementations teach the application of the elastic bands on a performed grip of a racket, the grip assembly of the present invention can just as readily be adapted for direct use on a bare shaft thereof to provide an interchangeable grip of advantageous character.

Many further variations and modifications of the grip assembly of the present invention could also be made without departing from the scope thereof. More particularly, the peripheral form, dimensions, and resilient character of each elastic band on a corresponding section of the handle portion of the racket can be adapted so as to provide a more ergonomic fit to a particular user's hands. Likewise, the shape of the inner sections of the elastic bands can be modified if necessary to provide greater retainment between adjacent bands and/or the underlying shaft. Further, individual elastic bands may be provided with specific colorations to indicate the characteristics thereof, such as resilient or weight. As such, the spirit and scope of the present invention should not be determined from the specificaties of the above disclosure but from the appended claims and their legal equivalents.

I claim:

1. In a games racket comprising a frame, a shaft adjoining therewith, and a handle portion on the free end of said shaft;

a plurality of generally annular elastic bands, each band having an inner cross section less than that of a corresponding section of said handle portion on which it is to be positioned, each said elastic band being tautly positioned around said corresponding section of said handle portion.

2. In a games racket as characterized in claim 1, wherein at least one said elastic band overlaps a portion of an adjacent said elastic band when positioned on said handle portion.

3. In a games racket as characterized in claim 2, wherein a cavity is defined between each pair of adjacent overlapping said elastic bands on said handle portion.

4. In a games racket as characterized in claim 3, wherein a groove is defined between each pair of adjacent overlapping said elastic bands on handle portion, each said groove extending in a circumferential direction thereon.

5. In a games racket as characterized in claim 2, wherein each said elastic band includes an inner layer for increasing the hold of said elastic band on said handle portion.

6. In a games racket as characterized in claim 2, wherein each said elastic band has a generally cylindrical form with circular ends.

7. In a games racket as characterized in claim 2, wherein each said elastic band has a generally cylindrical form with elliptical ends.

8. In a games racket as characterized in claim 2, wherein said elastic bands are provided with specific colorations for indicating the characteristics of said elastic bands.

9. In a games racket as characterized in claim 1, wherein said games racket further comprises a grip portion formed around said handle portion thereof, with said elastic bands being tautly positioned on said grip portion.

* * * * *